United States Patent [19]

Weisbrod

[11] 4,298,288

[45] Nov. 3, 1981

[54] MOBILE CONCRETING APPARATUS AND METHOD

[75] Inventor: Alvin J. Weisbrod, Huntington Beach, Calif.

[73] Assignee: Anthony Industries, Inc., City of Commerce, Calif.

[21] Appl. No.: 115,416

[22] Filed: Jan. 25, 1980

[51] Int. Cl.[3] ..... B28C 7/10; B28C 7/12; B28C 7/14

[52] U.S. Cl. ..... 366/8; 366/11; 366/16; 366/20; 366/27; 366/34; 366/35; 366/37; 366/51

[58] Field of Search ..... 366/5, 8, 11, 13, 15, 366/16, 17, 18, 19, 20, 27, 29, 34, 35, 37, 40, 43, 51, 64, 10, 3

[56] References Cited

U.S. PATENT DOCUMENTS

| | | | |
|---|---|---|---|
| 3,300,193 | 1/1967 | Badgett | 366/8 |
| 3,305,222 | 2/1967 | Foster | 366/35 |
| 3,387,829 | 6/1968 | Nangoh et al. | 366/37 |
| 3,485,481 | 12/1969 | Zimmerman | 366/51 |
| 3,871,628 | 3/1975 | Pulk et al. | 366/35 X |

FOREIGN PATENT DOCUMENTS

| | | | |
|---|---|---|---|
| 1478591 | 7/1977 | United Kingdom | 366/51 |

*Primary Examiner*—Philip R. Coe

*Attorney, Agent, or Firm*—Fulwider, Patton, Rieber, Lee & Utecht

[57] ABSTRACT

A mobile concreting apparatus and method which may be used, in particular, for on-site construction of swimming pools. It includes a vehicle supporting a plurality of containers, each adapted to contain one of the ingredients of concrete. Each container is provided with its own ingredient feeder which feeds the ingredients to a mixing device mounted on the vehicle to create a concrete slurry. The slurry is transferred from the mixing device to the surface to be coated by a structure including a slurry pump, a hose and a nozzle. Each ingredient feeder can be individually varied in the rate at which it feeds its ingredient so that the relative composition of the slurry, and the flow rate of the slurry, can be rapidly and selectively varied on the job site to meet the particular requirements for each job. In addition, feed rate settings which provide a desirable composition and overall feed rate can be noted and reproduced on subsequent occasions when the same composition and feed rate are desired.

12 Claims, 4 Drawing Figures

MOBILE CONCRETING APPARATUS AND METHOD

BACKGROUND OF THE INVENTION

This invention relates to an apparatus and method for transporting, metering, mixing, and applying the solid and liquid ingredients for concrete at a job site.

In the construction of certain concrete structures such as swimming pools, it is necessary to apply concrete to the sides and bottoms of the swimming pool. Conventional practice is to mix the basic ingredients of concrete to form a slurry and then to spray the slurry from a hose under sufficient pressure against the surface to be covered. An accelerator agent is injected as the concrete leaves the spray nozzle to cause it to harden almost immediately. The concrete spray product produced is sometimes termed "gunite."

Because swimming pools and similar structures requiring the use of this gunite approach are usually constructed at sites remote from conventional concrete plants, the logistics of concrete preparation are important both for economic and technical reasons. A variety of machines have been developed to aid in remote-site application of gunite. While generally satisfactory for their intended purposes, problems remain in the application of gunite to swimming pool construction applications.

A principal problem has been the operator's lack of control over the composition of the gunite mixture during the application process. In some cases, the basic concrete mixture was mixed at a central plant, trucked to the remote site, and then loaded into an applicator unit. The use of a slurry premixed at the central plant deprived the operator of the applicator unit of the ability to vary the composition of the concrete on the job site to match its consistency, hardening rate and other characteristics to the different requirements of different application situations found on-site in constructing a swimming pool.

In other cases, the ingredients were trucked to the remote site unmixed and then added to a mixer by laborers working at the direction of the operator. Here the mixture could be varied on-site, but imprecisely and with considerable lag in the composition of the applied gunite. In yet other cases, there has been an attempt to provide automated mixing of the ingredients, as where separate bins are filled with controlled amounts of the ingredients and then mixed. This approach has the inherent limitation of producing batches rather than a continuous flow of mixed concrete, with the result that the operator cannot readily alter the composition on short notice and for short periods.

Another problem with previous on-site application methods has been initial set up of the equipment and adjustment of the different proportions of the ingredients to obtain the mix necessary for a concrete slurry having the properties desired. This can result in initial production of unsatisfactory slurry which cannot be used and must be wasted before the proportions have been adjusted to obtain a mix of the desired characteristics.

An associated problem is the need for an economical, self-contained vehicle upon which all storage, mixing, pumping, and spraying functions can be centralized. Other machines for applying gunite have often required a variety of separate pieces of apparatus, including mixing trucks, central plant, applicator units, and power sources. This approach is uneconomical in that capital costs are high and several operators may be required for the separate pieces of machinery. It is also inconvenient and unsightly when operations are conducted in a residential neighborhood.

SUMMARY OF THE INVENTION

The invention is a mobile apparatus and method which provides in a single vehicle all the functions necessary for on-site, continuous preparation and application of a concrete slurry whose composition and flow rate can be selectively controlled to meet the requirements of differing jobs. The solid ingredients of the mixture are delivered into the mixing unit by electrically driven augers whose speeds can be individually varied to vary their delivery rates, and the liquid ingredients are delivered through valves or electrically driven pumps which can similarly be individually varied. The mixing auger is also driven by an electric motor, so that it delivers mixture to the pumping and applicator units at a rate controlled by the operator. By adjusting the individual flow rates of ingredients, the speed of the mixing auger, and the speed of the pump, the operator can vary the composition and delivery rate of the applied mixture accurately, repeatedly, and economically. Another important advantage is that the feed rates can be set in advance to values known from previous experience to provide slurry of desired consistency and at a desired feed rate.

By utilizing the invention, a constructor of swimming pools can load all the ingredients of concrete into the apparatus at the central plant and transport them to the construction site. At the site, by varying the flow rates of ingredients and of the mixing auger and gunite pump, the operator can select the relative proportions and overall feed rate which best fit the conditions, thereby matching feed rate and concrete composition to the requirements of each particular job. Moreover, the indicated motor speeds and valve settings can be recorded, allowing the operator to quickly reproduce the various settings at a later date. In this way, the quality of the concrete mixture and the resulting swimming pool are improved, capital and operating costs are reduced, and operations are less disruptive and unsightly, particularly in residential neighborhoods.

The apparatus includes a wheeled chassis supporting at its rear end a preloaded cement bin, which may be changed over with other cement bins as the process proceeds and the bins become depleted, and two hoppers for pea gravel and sand, respectively, which may be replenished during the job by a front end loader. The contents of the hoppers and the cement bin are delivered by three augers, each separately controlled by a separate electric motor, to a mixing auger open at the top for the reception of material. As the materials pass along the auger, they are mixed with water pumped from a tank in the vehicle which may be replenished during operations by connection to a water hydrant. They are also mixed with a slicking agent, specifically bentonite, to improve pumping capabilities of the slurry. The mixing auger thoroughly mixes the ingredients and delivers them to a mixing tank which communicates with two alternately stroking piston pumps. On the in-feed stroke of each piston pump, it fills with concrete from the mixing tank, while on the expulsion stroke the concrete is expelled through a swing tube into a flexible delivery pipe having a spray nozzle at its free end. The swing tube is moved from the outlet of one piston pump to the other, in synchronism with the motion of the pistons, by a hydraulic ram connected to the swing tube. Power for the piston pump is provided by a hydraulic pump driven by a main diesel engine. The diesel engine also drives an air compressor connected, via a compressed air tank, to a compressed air line which injects air under pressure into the nozzle to ensure that the concrete is sprayed forcibly against the surface to be coated. In addition, the apparatus provides for controlled injection of an accelerator to the slurry as it passes through the nozzle so that concrete will harden very rapidly after it has been sprayed onto the surface to be coated.

The foregoing, and other aspects of the invention, are set forth more fully in the detailed description hereafter.

BRIEF DESCRIPTION OF THE DRAWINGS

A mobile concreting apparatus constructed in accordance with the preferred embodiment of the invention is illustrated in the accompanying drawings, in which.

DETAILED DESCRIPTION

Figure 1:
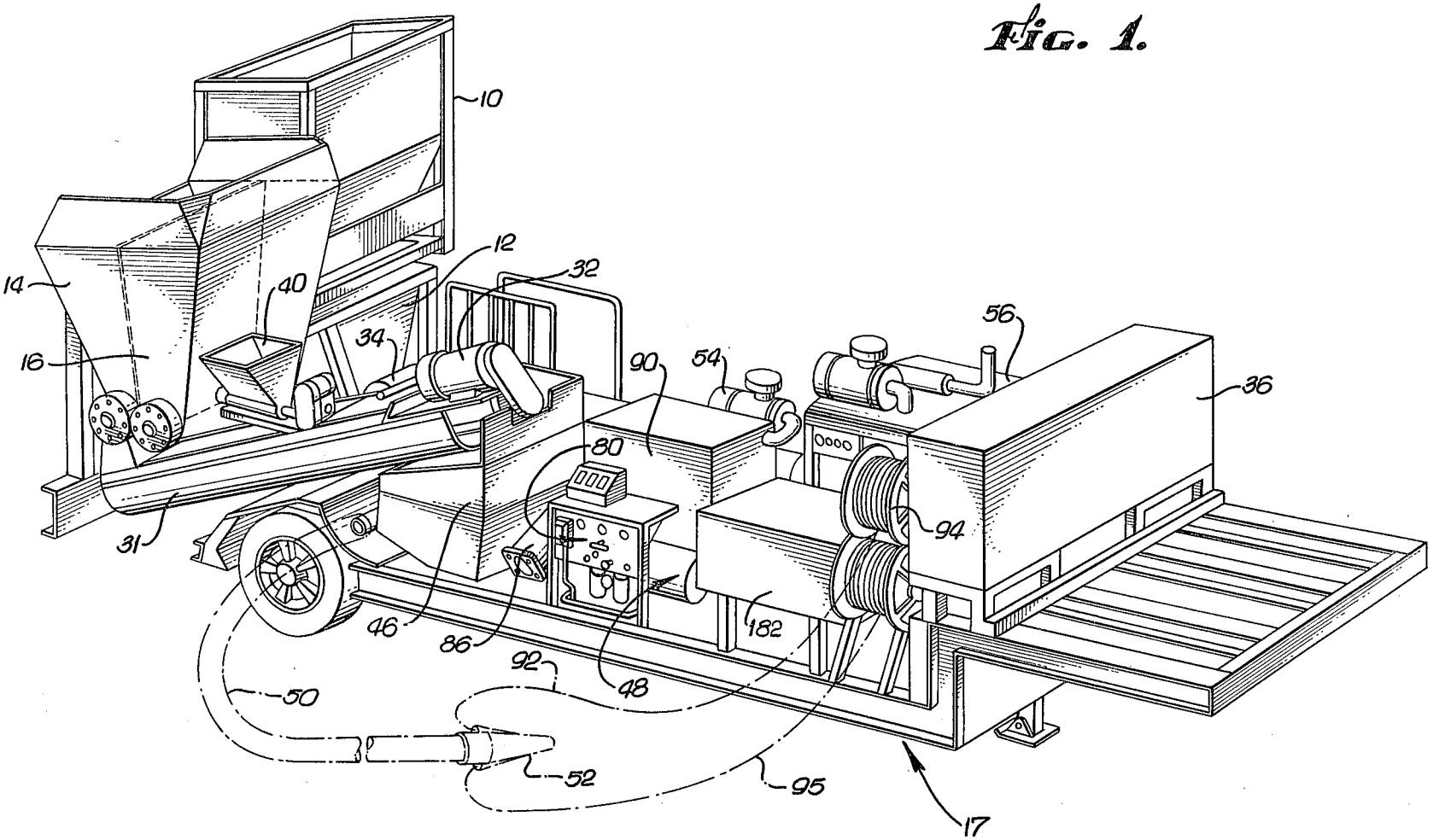
FIG. 1 is a perspective view of the mobile concreting apparatus.
Figure 2:
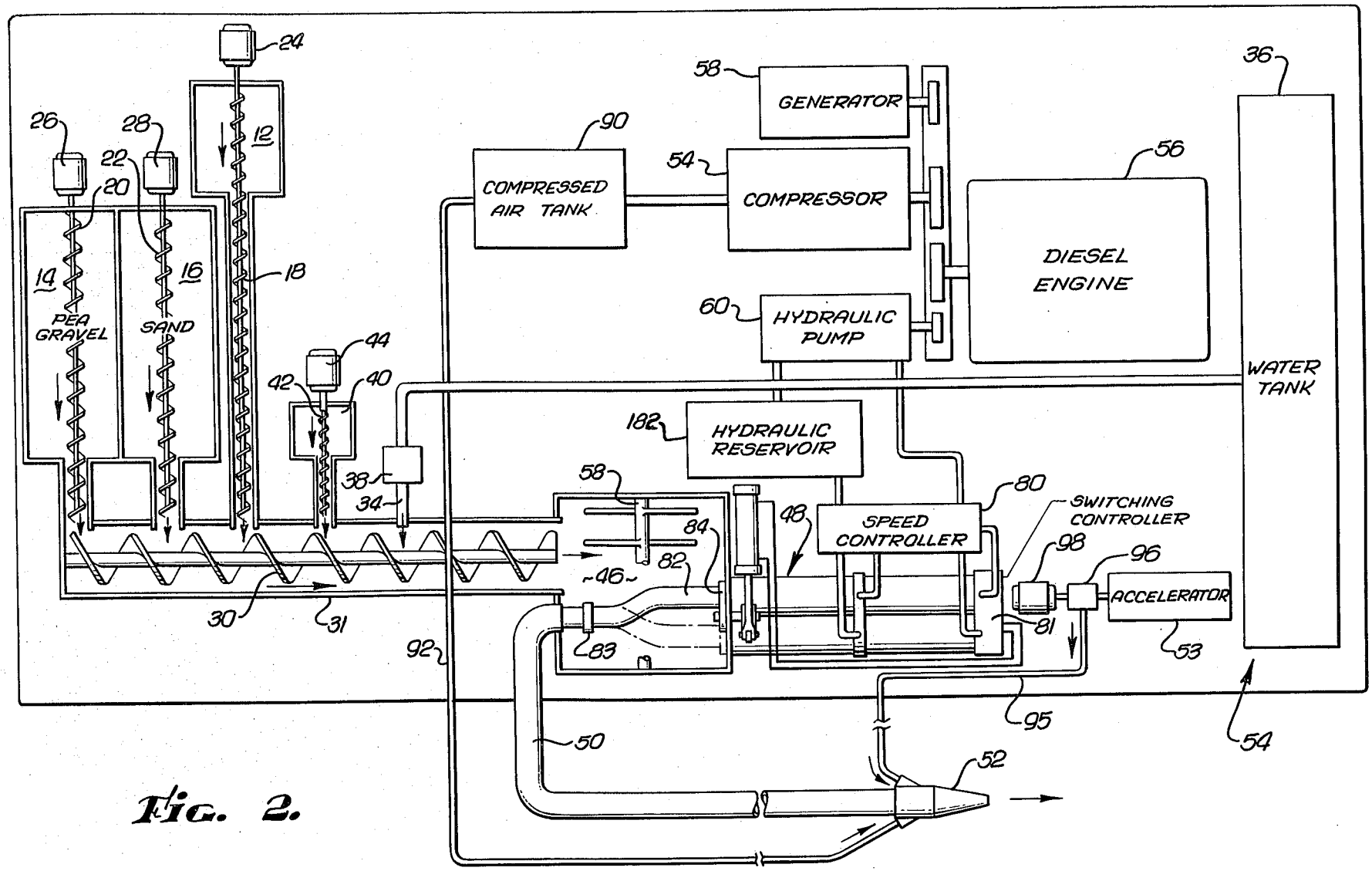
FIG. 2 is a schematic drawing of the entire mobile concreting apparatus.

A mobile concreting apparatus (FIG. 1) constructed in accordance with the preferred embodiment of the invention includes a bin 10 containing dry cement feeding into a cement hopper 12, a pea gravel hopper 14 containing pea gravel, and a hopper 16 containing sand. The foregoing components are mounted on a conventional vehicle, generally designated 17, such as a flat bed trailer for on-road travel. The ingredients are delivered by three separate ingredient feeding conveyors 18, 20 and 22, (FIG. 2) each comprising an auger driven by an associated electric motor, 24, 26 and 28, respectively, to a mixing auger 30. The mixing auger is mounted in an open trough 31 and is driven by an associated electric motor 32 (FIG. 1). In the mixing auger 30, the cement, pea gravel, and sand are mixed together with water, delivered through a pipe 34 from a tank 36 via a flow control valve 38, to form a concrete slurry. A slicking agent, to enable the slurry to be pumped with reduced friction, is added from a slicking agent hopper 40 by an auger 42 driven by an electric motor 44. The slurry is delivered by the mixing auger 38 to a holding tank 46 from which it is pumped by a hydraulically operated slurry applicator pump 48 through a delivery hose 50 to a nozzle 52. Compressed air from an air compressor 54 is injected at the nozzle to propel the slurry in a spray against the surface to be coated. A chemical accelerator from an accelerator tank 53 is added at the nozzle to promote rapid hardening of the concrete after it has been sprayed. Mounted on the vehicle is a diesel engine 56 which mechanically drives the air compressor 54 and also drives a alternating current generator 58 to provide power for the motors driving the augers. The engine 56 also mechanically drives a hydraulic pump 60 which provides a source of hydraulic fluid under pressure to operate the slurry pump 48.

Such apparatus enables the mixing of the ingredients at the job site to a desired consistency and flow and their application to the surface to be coated. Further, the control over feed rates that is available enables the feed rates to be set at the site to values determined in previous jobs to provide the desired mix and flow rate, thereby eliminating costly set-up time at the job site and waste of material during the start-up phase of each operation. In addition, the apparatus allows on-site control over the mix without requiring the assembly, hooking up and coordination of numerous different pieces of construction equipment at the job site.

In more detail, the previously referred-to hoppers 14 and 16 comprise a vertical container having downward and inwardly sloped sides, divided by a central wall into the separate noncommunicating hoppers for the pea gravel and the sand, respectively. The augers 20 and 22 run along the bottom of the hoppers 14 and 16 and feed their respective contents, through intervening conduit structure, into the open top of the trough 31 adjacent its rear, lower end. As the contents of the hoppers 14 and 16 are depleted during operation, they will be replenished from time to time by fresh pea gravel and sand fed into the top of each hopper from a front end loader.

Figure 3:
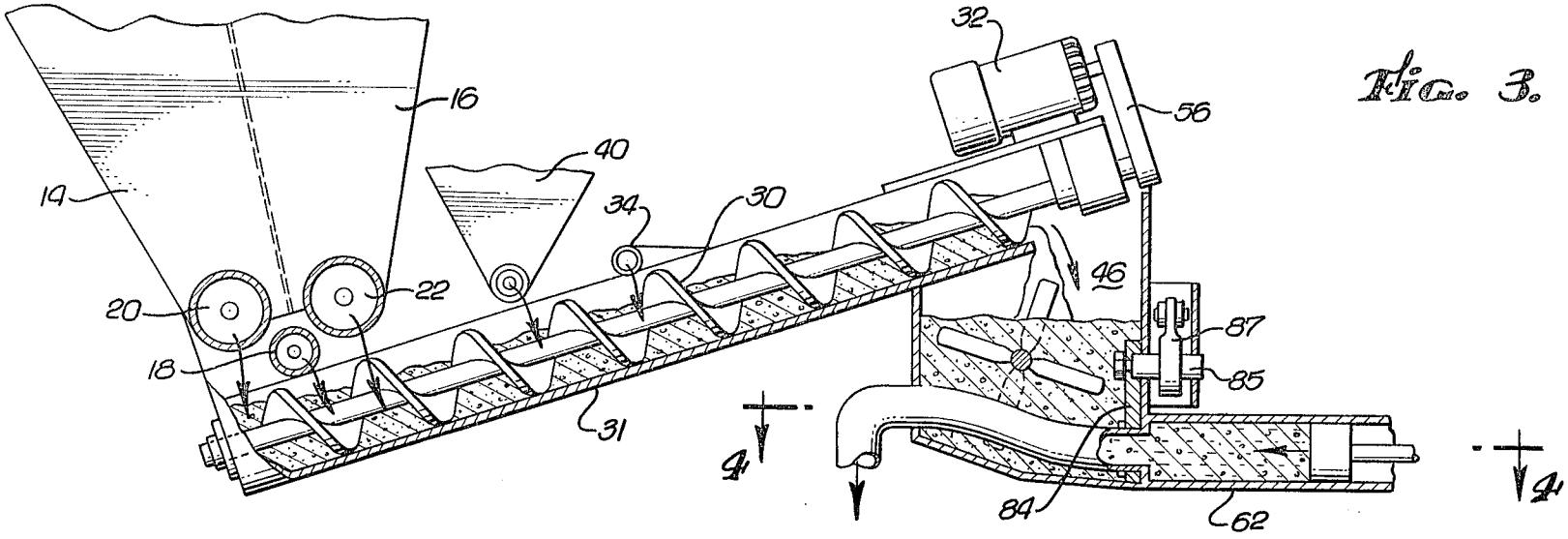
FIG. 3 is a cross-sectional side view of a mixing auger forming part of the concreting apparatus shown in FIG. 1.

The cement bin 10 is a vertical hopper having inwardly funnelled sides at its lower end terminating in a bottom opening which may be closed by a sliding plate (not shown). After the bin has been loaded with dry cement, it is placed on top of the cement hopper 12, by a fork lift or other lifting device. The sliding plate is then moved to open the bottom opening so that the dry cement falls into the cement hopper 12. The cement auger runs along the bottom of the cement hopper 12 and, through a conduit, to the mixing trough 31 into which the cement is deposited. As can be seen in FIG. 3, the cement auger actually runs beneath the pea gravel and sand hoppers. However, for simplicity of illustration, in FIG. 2 it is shown displaced to the right of the pea gravel and sand augers. After the cement bin has been fully emptied, it is released from the cement hopper, removed and replaced with another filled cement bin of the same construction.

The ingredients entering the mixing trough 31 are mixed and conveyed forwardly and upwardly along it by the mixing auger 30. The mixing auger 30 is tilted upward and forward with its delivery end higher, to promote mixing and to provide clearance above the holding tank 46. It is rotated by the electric motor 32, operating through a gearbox 56 (FIG. 3).

Water is added to the ingredients in the mixing trough 31 through the pipe 34 positioned adjacent its mid point. In the preferred embodiment, the water tank 36 is mounted on and secured to the chassis 17 adjacent the forward end. The water tank 36 is provided with a refill hose (not shown) which may be connected to a convenient water source, such as a water hydrant at the job site, to keep the tank filled with water as operations proceed. The rate of water flow through the pipe 34 to the mixing trough is controlled by the water valve 38 which, in the preferred embodiment, has a caliberated manual control.

Each of the motors 24, 26 and 28 for the augers feeding the flowable solid ingredients of the concrete is a alternating current constant speed motor connected to and driven by the output from the A.C. generator 58. Furthermore, each motor is provided with its own gear box, incorporating a manually operated knob or lever, which may be moved to change the rotational speed of the gear box output shaft to selectively vary the speed of the associated auger. The water valve 38 includes an operating handle and graduated scale. In operation of the apparatus, different feeding speeds for the flowable solid ingredients and of the position of the water valve can be made to vary the feed rates of the ingredients making up the slurry. This enables the relative proportions of each ingredient in the mix, and also the total feed rate of the mix, to be varied as desired, rapidly and at the job site. Particular combinations of settings and water valve settings can be recorded during operations using mix of selected composition and flow rates. These settings can be reproduced during the start-up phase of subsequent concreting jobs at another job site to achieve mix of the consistency and feed rate previously used without the waste involved in trial and error attempts to reach the desired mix and flow rate setting up equipment to begin operating.

The previously referred to slicking agent is a chemical which reduces the frictional resistance of the gunite mixture to subsequent passage through the hose 50, thereby reducing the power demands made upon the slurry pump 48. In the preferred embodiment of the invention, the slicking agent is the solid chemical bentonite or other like material in flowable, powder form. The slicking agent hopper 40 is mounted on the vehicle 17, between the hoppers 12, 14 and 16 and the water pipe 34, in proximity to the mixing auger 30. The slicking agent is transferred from the hopper into the open top of the mixing through by the auger 42, through an intervening conduit, at a rate determined by the speed of its associated drive motor 44. The motor 44 is also an alternating current motor which is connected to and powered by the A.C. generator 58 and has an associated gear box controlled by a lever to vary the speed of the auger. Thus the flow rate of the slicking agent can be selectively varied to suit the characteristics and flow rate of the slurry being fed through the mixing auger.

The slurry is delivered by the mixing auger 30 to the holding tank 46. The holding tank 46 provides a reservoir of material for the slurry pump 48 and, furthermore, buffers temporary differences in the delivery flow rate of the mixing auger 30 and the pumping flow rate of the slurry pump 48. The holding tank 46 contains a paddlewheel stirrer 58 which prevents any stratification of the slurried mixture in the tank and promotes a smooth flow of mixture to the slurry pump 48.

Figure 4:
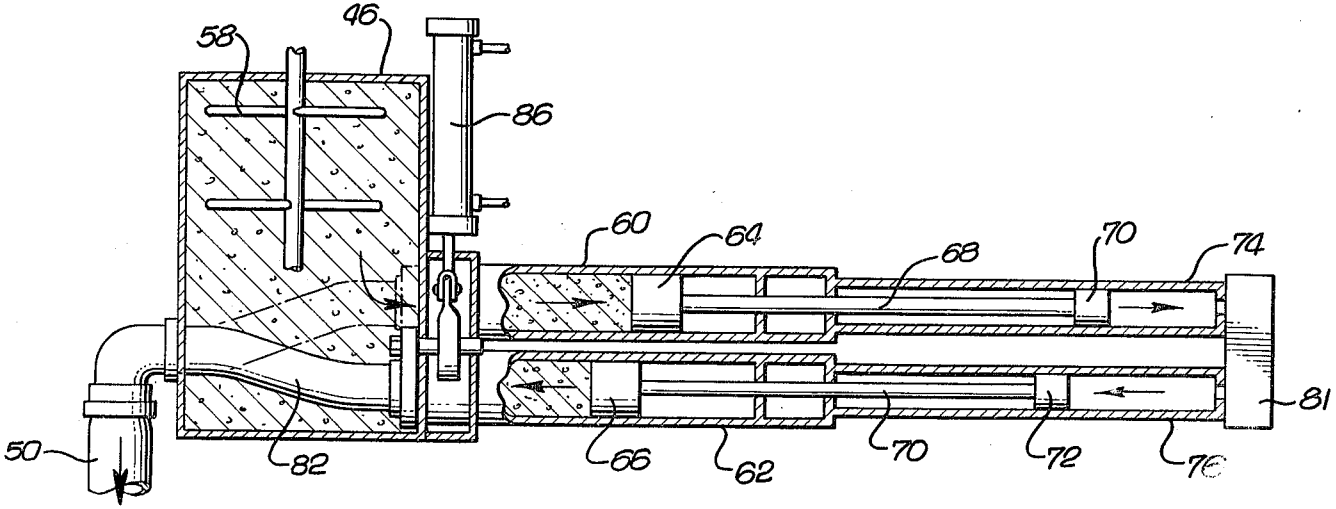
FIG. 4 is a cross-sectional top view of a dual-cylinder pump and swing tube forming part of the concreting apparatus shown in FIG. 1.

The slurry pump 48 (FIG. 4) comprises two horizontal piston pump cylinders 60 and 62 each of which is connected at its rear end to the mixing tank 46 communicating with its interior. Positioned within the cylinders 60 and 62 are sliding pistons 64 and 66 connected by rods 68 and 70 to hydraulic pistons 70 and 72, respectively. The hydraulic pistons are mounted within hydraulic cylinders 74 and 76 and hydraulic fluid may be selectively admitted and exhausted from either end of each hydraulic cylinder to cause reciprocation of the pistons. A speed controller 80 directs high pressure hydraulic fluid from the hydraulic pump 60 to a switching controller 81 which controls admission of the fluid to the hydraulic cylinders 74 and 76 in alternately stroking sequence. Fluid from the cylinders exhausts to a hydraulic reservoir 182. While concrete slurry is being drawn into one of the pump cylinders 60 and 62 on the in-feed stroke of the piston in that cylinder, it is being simultaneously expelled on the expulsion stroke of the piston in the other pump cylinder. The speed controller 80 includes conventional, electrically driven timing mechanism for variably controlling the strokes per minute of the piston pumps, and hence the rate at which the slurry is delivered to the hose 50, to be selectively controlled.

The slurry pump 48 also includes a swing tube 82 connected to the rear wall of the holding tank and communicating with the hose 50. The swing tube is bent along its length so that its forward region is parallel to but radially offset from its rear region. It also incorporates a rotatable joint 83. As the swing tube is oscillated, its forward end moves between two extreme positions in which it registers with one or other of the pump cylinders 60 and 62. Oscillation of the forward end of the swing tube between its extreme positions is effected by an oscillation mechanism comprising an arm 84 (FIG. 3) having one end connected to the swing tube and connected at its other end to an axle 85 mounted in and projecting through the tank wall. The axle is rotated in opposite directions by a hydraulic jack 86 mounted to the vehicle, which has a piston rod connected by a crank 87 to the axle 85.

The switching controller 81 is also connected to the ram 86 and controls the admission and exhaust of hydraulic fluid to opposite ends of the ram in timed relation to the operation of the admission and exhaust of fluid to the hydraulic cylinders 74 and 76 to position the swing tube in registry with whichever of the two piston pumps is on its expulsion stroke. In the preferred embodiment the slurry pump, including the two piston pumps, the swing tube, the mechanism for oscillating the swing tube, the speed controller and the switching controller are parts of a commercially available system known as the Sidewinder 45 concrete pump manufactured by Transcrete Pty. Ltd., Sydney, Australia, available in this country through Bennett Bros. Inc., 5910 Firestone Blvd., Southgate, Calif.

Concrete flows from the swing tube 82 through the flexible delivery hose 50 to the nozzle 52. In operation, the delivery hose 50 is many feet in length so that the vehicle 17 may be located in a street or driveway and the concrete may be delivered by the delivery hose 50 to a swimming pool under construction in a backyard. The slurry pump 48 provides sufficient pressure to force the concrete the length of the delivery hose 50 and out of the nozzle.

To accelerate the slurry from the nozzle 52 with enough velocity for spraying, compressed air is injected into the flowing slurry at the nozzle. The compressed air is fed from a compressed air tank 90 mounted on the vehicle via flexible high pressure air pipe 92 (FIG. 1). Air is supplied to the air tank by the air compressor 54. The air pipe is coiled on an air hose reel 94 mounted at front of the vehicle (from which it may be fed) and is connected at its other end to the nozzle to inject the compressed air into the slurry to accomplish the desired spraying function.

It is desirable that, after the concrete has been sprayed from the nozzle 52, it should harden rapidly to speed completion of the coating operation and avoid dripping and running. The accelerator chemical, which is liquid, is stored in the accelerator tank 53 and pumped to the nozzle 52 through an accelerator hose 95 by a pump 96. The pump 96 is driven by a variable speed air motor 98. The motor includes a manual controller such as a knob or lever which may be moved relative to a graduated scale to vary the motor r.p.m. and thereby selectively determine the rate of flow of accelerator.

By individually varying the speeds of the augers controlling the feed rates of the flowable solids, by selectively opening or closing the water valve 38, and by varying the speed of the motor for the pump for the accelerator, the outlet air pressure in the compressed air tank 90, and the pumping speed of the slurry pump 48, the operator is able to control with accuracy, and reproducibility on subsequent occasions the overall flow rate of concrete produced, the relative proportions of the ingredients, and the spray conditions and its hardening rate. This flexibility of operation allows the operator to optimize the concreting operations through control over the composition and characteristics of the concrete and the rate of application for any desired application. While, for some applications, the control settings may not need to be changed from one job to the next, this apparatus enables changes required for other applications to be made on the job site rapidly and as necessary. For example, the optimal composition may be different for swimming pool walls, bottoms, decks, or other specific areas or in weather conditions of differing relative humidity. Moreover, in the initial start-up phase of an operation, requiring a mix and flow rate previously used on another job and known to be satisfactory, the operator can set the controls to values previously recorded for the earlier occasion thereby avoiding the waste of material and time involved in a trial and error approach to reproduce the previous results.

Although the invention has been described with reference to the preferred embodiment, it will be appreciated that many changes and modifications may be made without departing from the spirit of the invention defined by the appended claims.

I claim:

1. A mobile concreting apparatus for preparing a wet concrete slurry, from flowable solid ingredients therefor and water, and applying the wet slurry to a surface at a job site, the concreting apparatus comprising, a plurality of containers, each adapted to contain one of the flowable solid ingredients, a plurality of separate ingredient-feeding means, one for each ingredient, each of said ingredient-feeding means being connected to an associated one of said containers for feeding the ingredient contained in said container therefrom, a plurality of control means, each said control means being connected to an associated one of said ingredient-feeding means for individually controlling the feed rate thereof, mixing means connected to said ingredient-feeding means for receiving and mixing the ingredients fed thereto, water supply means connected to said mixing means for supplying water thereto at an individually controllable rate, said mixing means mixing the flowable solid ingredients and the water to a wet concrete slurry, a vehicle connected to and carrying said containers, said ingredient conveyor means, said control means and mixing means;

a hose, a nozzle connected to one end of said hose for applying concrete to the surface, and pump means connected to said mixing means and the other end of said hose for pumping the wet concrete slurry through said hose at a feed rate which is controllable independently of the feed rates of said ingredients to said mixing means.

2. A mobile concreting apparatus as defined in claim 1, wherein each of said plurality of ingredient-feeding means includes, a conveyor connected to the associated one of said containers for conveying the flowable solid ingredient contained therein to said mixing means; and driving means connected to said conveyor for driving said conveyor to convey such flowable solid ingredient to said mixing means at an individually variable rate.

3. A mobile concreting apparatus as defined in claim 2 wherein, each said driving means includes, an electric motor connected to the associated one of said conveyors; and means for selectively varying the speed at which said conveyor is driven by the associated said electric motor.

4. A mobile concreting apparatus as defined in claim 1, further including, a source of compressed air connected to and carried by said vehicle; and an air pipe connected to said source of compressed air and said nozzle for injecting air into said nozzle to cause the slurry to be sprayed from the nozzle against the surface to be coated.

5. A mobile concreting apparatus as defined in claim 1 having the capability to add an accelerator in liquid form to the slurry immediately prior to its application to the surface to cause rapid hardening of the concrete, wherein said applicator means includes, a container for the accelerator mounted on and carried by said vehicle, and accelerator feeding means connected with said nozzle and said container for the accelerator for feeding the accelerator into the slurry at a selectively variable rate as the slurry passes through said nozzle.

6. A mobile concreting apparatus as defined in claim 1 having the capability to add a slicking agent to the slurry before it enters said applicator means, the concreting apparatus further including, a slicking agent container mounted on and carried by said vehicle; and slicking-agent feeding means connected with said container therefor for feeding the slicking agent therefrom into the slurry at a selectively variable rate.

7. A mobile concreting apparatus as defined in claim 1 wherein said mixing pump means includes, a tank receiving the slurry, an outlet port mounted in said tank communicating with said hose, a pair of alternately-stroking piston pumps each having a pumping chamber communicating with the interior of said receiving tank, each said pump having an in-feed stroke in which slurry is withdrawn from said tank into said pumping chamber followed by an expulsion stroke expelling slurry from said pumping chamber, a swing tube mounted in said receiving tank for oscillating motion between two alternate positions, said swing tube having one end in continuous communication with said outlet port and, means for oscillating said swing tube in timed relation to the movement of said piston pumps to place its opposite end in alternate communication with the pumping chambers of said piston pumps on the expulsion stroke of each said piston pump.

8. A mobile concreting apparatus for preparing a concrete slurry from cement, gravel, sand, and water and applying the slurry to a surface at a job site, the concreting apparatus comprising, a vehicle, a cement container, a gravel container, a sand container, and a water container, all connected to and carried by said vehicle, a cement metering auger, a gravel metering auger, a sand metering auger, each of such augers being connected to associated ones of said containers and driven by an associated one of a plurality of electric motors, a water valve connected to said water container and controllable to vary the rate of flow of the water from said water container, a cement auger control means, a gravel auger control means, and a sand auger control means, each separately connected to the associated electric motors to allow the speed of the associated auger to be separately controlled, thereby separately varying the flow rate of material through each auger, mixing means for receiving and mixing the ingredients fed by said cement, gravel, and sand metering augers and said water valve to form a wet concrete slurry, pump means for pumping the slurry from said mixing means at a controllable feed rate which is independent of the flow rates of material through each auger and the flow rate of water through said water valve, a nozzle; and a hose connected to receive the wet concrete slurry pumped by said pump means and to convey the concrete slurry to said nozzle for application to the surface to be coated.

9. A process for preparing and applying a concrete slurry to structures, utilizing containers for flowable solid ingredients mounted on a vehicle, a plurality of conveying means for separately conveying each of the solid ingredients from its container at an individually controllable rate, mixing means for mixing the solid ingredients with water to form a wet concrete slurry, and application means for applying the slurry to a structure, the process comprising the steps of, feeding the flowable solid ingredients to the mixing means, individually adjusting the feed rates of the conveying means to vary the relative proportions of the flowable solid ingredients, feeding the water to the mixing means, including individually adjusting the feed rate of the liquid ingredient, mixing the water and flowable solid ingredients to form a wet concrete slurry, pumping the wet concrete slurry through a hose at a feed rate adjustable independently of the feed rates of the liquid and flowable solid ingredients to the mixing means, and applying the wet concrete slurry to the structure through a nozzle connected to the hose.

10. A mobile concreting apparatus for preparing a wet concrete slurry from flowable solid ingredients including cement, sand and gravel mixed with water and applying the slurry to a surface at a job site, the concreting apparatus comprising, a vehicle, a plurality of containers mounted on the vehicle each adapted to contain one of the flowable solid ingredients, a plurality of separate ingredient-feeding means, one for each flowable solid ingredient, each of said ingredient-feeding means being connected to an associated one of said containers for feeding the ingredient contained in said container therefrom, a plurality of control means, each said control means being connected to an associated one of said ingredient-feeding means for individually controlling the feed rate thereof, mixing means connected to said ingredient-feeding means for receiving and mixing the ingredients fed thereby, water supply means connected to said mixing means for adding water to the ingredients, being mixed in said mixing means, at a selectively controllable rate to create a wet concrete slurry incorporating the gravel, a hose; and pump means connected to said mixing means and to one end of said hose for pumping the wet concrete slurry along said hose at a selectively controllable rate, whereby slurry may be delivered by the hose to the job site.

11. A mobile concreting apparatus as defined in claim 10 further including, a nozzle connected to the other end of said hose; and air supply means mounted on said vehicle connected to said nozzle for injecting air under pressure into the wet concrete slurry as it leaves the nozzle to cause it to be sprayed from said nozzle.

12. A mobile concreting apparatus as defined in claim 10 wherein an accelerator chemical is to be added to the concrete slurry to increase the rate at which the slurry hardens into solidified concrete, the mobile concreting apparatus further including, accelerator supply means mounted on said vehicle connected to said nozzle for introducing the accelerator into the wet concrete slurry just prior to its exit from the nozzle at a selectively controllable rate.

* * * * *

UNITED STATES PATENT AND TRADEMARK OFFICE

CERTIFICATE OF CORRECTION

PATENT NO. : 4,298,288

DATED : November 3, 1981

INVENTOR(S) : Alvin J. Weisbrod

It is certified that error appears in the above—identified patent and that said Letters Patent is hereby corrected as shown below:

Column 5, line 12, "rates" should read -- rate --.

Column 5, line 30, delete "through" (first occurrence) and insert therefor -- trough --.

In the Claims:

Claim 7, line 49, delete "mixing"

Signed and Sealed this

*Second* Day of *February 1982*

[SEAL]

*Attest:*

GERALD J. MOSSINGHOFF

*Attesting Officer*

*Commissioner of Patents and Trademarks*